US012781147B2

(12) United States Patent
Paustian et al.

(10) Patent No.: US 12,781,147 B2
(45) Date of Patent: Nov. 3, 2026

(54) PROCESS TO PRODUCE FUELS FROM LIGHT OLEFINS HAVING IMPROVED YIELD

(71) Applicant: UOP LLC, Des Plaines, IL (US)

(72) Inventors: Joel S. Paustian, Vernon Hills, IL (US); Jeannie M. Blommel, Oregon, WI (US); Matthew C. Cole, Evanston, IL (US); Ernest J. Boehm, Hanover Park, IL (US); Ian G. Horn, Streamwood, IL (US); Andrew B. Chin, Wilmette, IL (US)

(73) Assignee: UOP LLC

( * ) Notice: Subject to any disclaimer, the term of this patent is extended or adjusted under 35 U.S.C. 154(b) by 190 days.

(21) Appl. No.: 18/906,418

(22) Filed: Oct. 4, 2024

(65) Prior Publication Data

US 2026/0098223 A1 Apr. 9, 2026

(51) Int. Cl.
*C10L 1/04* (2006.01)
*C10G 69/12* (2006.01)

(52) U.S. Cl.
CPC ..... *C10L 1/04* (2013.01); *C10G 69/126* (2013.01); *C10G 2300/1092* (2013.01); *C10L 2200/0415* (2013.01); *C10L 2200/043* (2013.01); *C10L 2200/0453* (2013.01)

(58) Field of Classification Search
CPC ..... C10L 1/04; C10L 2200/0415; C10L 2200/043; C10L 2200/0453; C10G 69/126; C10G 2300/1092; C10G 45/00; C10G 50/00; C10G 2300/4081; C10G 2400/02; C10G 2400/08
See application file for complete search history.

(56) References Cited

U.S. PATENT DOCUMENTS

2007/0203382 A1 8/2007 Senetar
2015/0159099 A1 6/2015 Luebke et al.
2015/0376082 A1 12/2015 Nicholas et al.
2016/0312133 A1* 10/2016 Fichtl ..... C10G 50/00
2016/0312134 A1* 10/2016 Fichtl ..... C10G 69/126
(Continued)

FOREIGN PATENT DOCUMENTS

WO 2017075209 A1 5/2017

OTHER PUBLICATIONS

International Search Report from corresponding PCT application No. PCT/US2025/048429, mailed Jan. 26, 2026.
(Continued)

*Primary Examiner* — Ellen M McAvoy

(57) ABSTRACT

Processes for producing fuels from light olefins having increased yield are described. The processes include concentrating a crude olefin stream to produce a concentrated crude olefin stream; fractionating the concentrated crude olefin stream to produce an olefin stream and a waste gas stream, oligomerizing the olefin to produce an oligomerization effluent stream, fractionating the oligomerization effluent stream into a fractionated oligomerized stream comprising $C_{9+}$ olefins, a recycle olefin stream, and an unsaturated light gas stream, recycling at least a portion of the unsaturated light gas stream to the olefin concentration zone or the olefin fractionation zone, and fractionating the fractionated oligomerized stream to produce at least one fuel stream.

20 Claims, 4 Drawing Sheets

(56) References Cited

U.S. PATENT DOCUMENTS

| | | | | |
|---|---|---|---|---|
| 2017/0044443 | A1 | 2/2017 | Blommel et al. | |
| 2017/0218283 | A1 | 8/2017 | Lilga et al. | |
| 2019/0119182 | A1 | 4/2019 | McCormick et al. | |
| 2020/0087587 | A1* | 3/2020 | D'Acosta | C10L 1/04 |
| 2023/0160633 | A1 | 5/2023 | Zhao et al. | |
| 2024/0182801 | A1 | 6/2024 | Gosangari et al. | |
| 2024/0246887 | A1* | 7/2024 | Mathur | C07C 2/24 |
| 2024/0247198 | A1 | 7/2024 | Mathur et al. | |
| 2025/0084331 | A1* | 3/2025 | Webster-Gardiner | C10G 69/126 |
| 2025/0243133 | A1* | 7/2025 | Georg | C07C 2/12 |
| 2026/0001823 | A1* | 1/2026 | Chakrabarti | C07C 2/74 |
| 2026/0028544 | A1* | 1/2026 | Paustian | C10L 1/04 |
| 2026/0049256 | A1* | 2/2026 | Malinski | C10G 3/42 |

OTHER PUBLICATIONS

Written Opinion from corresponding PCT application No. PCT/US2025/048429, mailed Jan. 26, 2026.
International Search Report from PCT application No. PCT/US2025/044106, mailed Dec. 24, 2025.
Written Opinion from PCT application No. PCT/US2025/044106, mailed Dec. 24, 2025.

* cited by examiner

PROCESS TO PRODUCE FUELS FROM LIGHT OLEFINS HAVING IMPROVED YIELD

BACKGROUND

There is great interest in reducing carbon emissions in the global transportation sector in order to combat climate change. One sector that is particularly difficult to decarbonize is the aviation sector. Therefore, a process to create aviation fuel from sustainable sources is needed. There are a number of processes to create alcohols, especially methanol and ethanol, from biological sources, municipal waste, or from renewable power and captured $CO_2$. Honeywell has several processes to convert these alcohols to renewable fuels such as renewable naphtha, renewable jet fuel (or sustainable aviation fuel or SAF), and renewable diesel.

In the process of making the SAF, a small amount of light paraffins byproducts are formed in the oligomerization reactions. To prevent the accumulation of the light paraffins, unconverted ethylene and propylene are fractionated in a depropanizer column as an off gas stream, and a small drag stream from the light olefin recycle is sent to the hydrogenation reactor to be saturated. The saturated components from the drag stream become fuel gas and naphtha product in the downstream fractionation section. Customers typically want to maximize SAF production and minimize byproducts.

Therefore, there is a need for a process for reducing carbon losses in an SAF process.

DESCRIPTION

Figure 1:
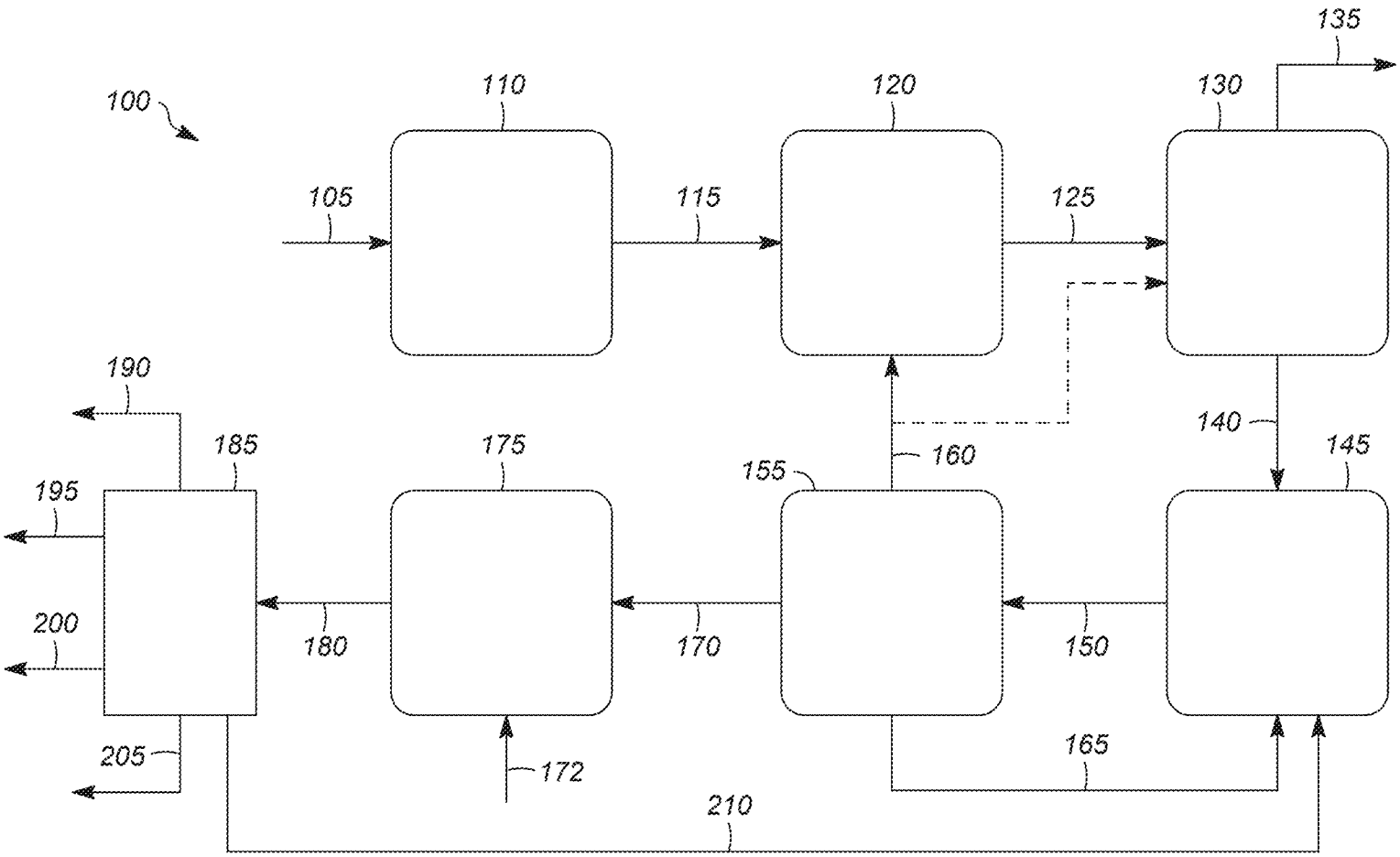
FIG. 1 is an illustration of one embodiment of the alcohol to aviation fuel process of the present invention.

To maximize the yield, the standard process was modified to recycle unconverted ethylene and/or propylene in the olefin rectifier overhead stream from the oligomerization fractionation zone to a concentration step or an olefin fractionation step. This change also enables a reduction in the oligomerization stage one reactor temperature; operating at lower conversion reduces yield losses to light paraffins. The changes resulted in an aviation fuel carbon yield increase of 2.7 wt %.

One aspect of the invention is a process to produce fuels from light olefins. In one embodiment, the process comprises concentrating a crude olefin stream comprising $C_2$ to $C_6$ olefins to produce a concentrated crude olefin stream. The crude olefin stream may comprise one or more of the $C_2$ to $C_6$ olefins; for example, the crude olefin stream may comprise $C_2$ olefins, or $C_3$ olefins, or $C_4$ olefins, or $C_5$ olefins, or $C_6$ olefins, or combinations thereof.

The concentrated crude olefin stream is fractionated in an olefin fractionation zone comprising an olefin fractionation column to produce an olefin stream comprising $C_2$ to $C_6$ olefins and a waste gas stream comprising $C_1$ to $C_3$ paraffins, hydrogen, and carbon monoxide. The olefin stream is oligomerized in an oligomerization reaction zone comprising an oligomerization reactor to produce an oligomerization effluent stream comprising $C_2$ to $C_{22+}$ olefins. The oligomerization effluent stream is fractionated in an oligomerization fractionation zone comprising an oligomerization fractionation column into a fractionated oligomerized stream comprising $C_{9+}$ olefins, a recycle olefin stream comprising $C_4$ to $C_5$ olefins, and an unsaturated light gas stream comprising $C_2$ to $C_3$ olefins and $C_2$ to $C_3$ paraffins. At least a portion of the unsaturated light gas stream is recycled to the olefin concentration zone or the olefin fractionation zone. The fractionated oligomerized stream is fractionated to produce at least one fuel stream.

The olefin fractionation zone and the oligomerization fractionation zone may comprise one or more fractionation columns.

In some embodiments, the process further comprises hydrogenating the fractionated oligomerized stream in the presence of hydrogen in a hydrogenation reaction zone comprising a hydrogenation reactor to form a hydrogenated stream comprising $C_1$ to $C_{22+}$ paraffins.

In some embodiments, fractionating the fractionated oligomerized stream comprises fractionating the hydrogenated stream in a hydrogenation fractionation zone comprising a hydrogenation fractionation column to produce an aviation fuel stream comprising $C_9$ to $C_{19}$ paraffins, or a diesel stream comprising $C_{19+}$ paraffins, or both.

In some embodiments, fractionating the hydrogenated stream to produce the aviation fuel stream, or the diesel stream, or both comprises fractionating the hydrogenated stream to produce the aviation fuel stream, or the diesel stream, or both and a saturated light gas stream comprising hydrogen and $C_1$ to $C_4$ paraffins, or a naphtha stream comprising $C_5$ to $C_8$ paraffins, or both.

In some embodiments, the process further comprises recycling a portion of the aviation fuel stream, or the diesel stream, or both to the oligomerization reaction zone.

In some embodiments, concentrating the crude olefin stream comprises compressing the crude olefin stream in a crude olefin compressor to form a compressed crude olefin stream; and drying the compressed crude olefin stream in a dryer to produce the concentrated crude olefin stream.

In some embodiments, the process further comprises contacting the crude olefin stream with water in an oxygenate absorber to produce an oxygenate lean crude olefin stream and an oxygenate rich water stream; and wherein compressing the crude olefin stream comprises compressing the oxygenate lean crude olefin stream.

In some embodiments, the process further comprises contacting the crude olefin stream with an alcohol in an ether absorber before contacting the crude olefin stream with the water to produce an ether and oxygenate lean crude olefin stream and an ether rich alcohol stream; and wherein compressing the crude olefin stream comprises compressing the ether and oxygenate lean crude olefin stream.

In some embodiments, the process further comprises contacting the crude olefin stream with an alcohol in an ether absorber to produce an ether lean crude olefin stream and an ether rich alcohol stream; and wherein compressing the crude olefin stream comprises compressing the ether lean crude olefin stream.

In some embodiments, the process further comprises contacting the compressed crude olefin stream with water in an oxygenate absorber to produce an oxygenate lean crude olefin stream and an oxygenate rich water stream; wherein drying the compressed crude olefin stream comprises drying the oxygenate lean crude olefin stream.

In some embodiments, the process further comprises compressing the oxygenate lean crude olefin stream to form a compressed oxygenate lean crude olefin stream; and wherein drying the compressed crude olefin stream comprises drying the compressed oxygenate lean crude olefin stream.

In some embodiments, the process further comprises stripping the compressed crude olefin stream in a light olefins stripper to produce an ether rich light crude olefin stream and an ether lean heavy crude olefin stream; and wherein drying the compressed crude olefin stream comprises drying the ether rich light crude olefin stream.

In some embodiments, the process further comprises contacting the compressed crude olefin stream with water in an oxygenate absorber before stripping the crude olefin stream to produce an oxygenate lean crude olefin stream and an oxygenate rich water stream; and wherein stripping the crude olefin stream comprises stripping the oxygenate lean crude olefin stream.

In some embodiments, the process further comprises contacting the compressed crude olefin stream with a caustic solution in a scrubber to produce a carbon dioxide lean crude olefin stream and a carbon dioxide rich spent caustic stream; and wherein drying the compressed crude olefin stream comprises drying the carbon dioxide lean crude olefin stream.

In some embodiments, the process further comprises contacting the compressed crude olefin stream with water in an oxygenate absorber before contacting the compressed crude olefin stream with the caustic solution to produce an oxygenate lean crude olefin stream and an oxygenate rich water stream; and wherein contacting the compressed crude olefin stream with the caustic solution comprises contacting the oxygenate lean crude olefin stream with the caustic solution.

In some embodiments, the process further comprises compressing the oxygenate lean crude olefin stream before contacting the oxygenate lean crude olefin stream with the caustic solution.

In some embodiments, the process further comprises stripping the compressed crude olefin stream in a light olefins stripper before contacting the compressed crude olefin stream with the caustic solution to produce an ether rich light crude olefin stream and an ether lean heavy crude olefin stream; and wherein contacting the compressed crude olefin stream with the caustic solution comprises contacting the ether rich light crude olefin stream with the caustic solution.

In some embodiments, the process further comprises contacting the compressed crude olefin stream with water in an oxygenate absorber before stripping the compressed crude olefin stream to produce an oxygenate lean crude olefin stream and an oxygenate rich water stream; and wherein stripping the compressed crude olefin stream comprises stripping the oxygenate lean crude olefin stream.

In some embodiments, the process further comprises compressing the oxygenate lean crude olefin stream before stripping the oxygenate lean crude olefin stream.

In some embodiments, drying the compressed crude olefin stream comprises drying the compressed crude olefin stream with a molecular sieve, or in a dryer, or in a combination vapor-phase and liquid-phase dryer, or combinations thereof.

In some embodiments, recycling at least the portion of the unsaturated light gas stream to the olefin concentration zone comprises: recycling at least the portion of the unsaturated light gas stream to the crude olefin compressor or a second compressor; or recycling at least the portion of the unsaturated light gas stream to the dryer; or both.

In some embodiments, fractionating the concentrated olefin stream comprises stripping the concentrated olefin stream in a light ends stripper to produce a waste gas stream comprising hydrogen, methane, and CO and a stripped olefin stream comprising $C_{2+}$ olefins; and wherein oligomerizing the olefin stream from the olefin fractionation zone comprises oligomerizing the stripped olefin stream.

In some embodiments, the process further comprises fractionating the stripped olefin stream in a deethanizer to produce a crude ethylene stream comprising ethylene and ethane and a heavy olefin stream comprising $C_{3+}$ olefins; and fractionating at least a portion of the crude ethylene stream in a $C_2$ splitter to create an ethylene stream and an ethane stream; wherein oligomerizing the olefin stream from the olefin fractionation zone comprises oligomerizing the ethylene stream, optionally a portion of the crude ethylene stream, and optionally the heavy olefin stream; and wherein the waste gas stream further comprises the ethane stream and optionally the heavy olefin stream.

In some embodiments, the process further comprises fractionating the heavy olefin stream from the deethanizer in an olefin rectifier to produce a crude propylene stream comprising propylene and propane and a second heavy olefin stream comprising $C_{4+}$ olefins; wherein the olefin stream from the olefin fractionation zone comprises the ethylene stream, the crude propylene stream, optionally the second heavy olefin stream, and optionally a portion of the crude ethylene stream; and wherein the waste gas stream further comprises the ethane stream and optionally the second heavy olefin stream.

In some embodiments, the process further comprises fractionating at least a portion of the crude propylene stream in a $C_3$ splitter to produce a propylene stream and a propane stream; and wherein the olefin stream from the olefin fractionation zone comprises the ethylene stream, the propylene stream, optionally the second heavy olefin stream, optionally a portion of the crude ethylene stream, and optionally a portion of the crude propylene stream; and wherein the waste gas stream further comprises the ethane stream, the propane stream, and optionally the second heavy olefin stream.

In some embodiments, the process further comprises contacting the heavy olefin stream with water in a water wash column to produce an ether-lean heavy olefin stream comprising $C_{3+}$ olefins and an ether-rich water stream comprising water and dimethyl ether; and wherein fractionating the heavy olefin stream from the deethanizer comprises fractionating the ether-lean heavy olefin stream.

In some embodiments, the process further comprises fractionating the ether-rich water stream to produce an ether stream comprising dimethyl ether and a water stream comprising water; and recycling the water stream to the water wash column.

In some embodiments, the process further comprises contacting the propane stream with water in a second water wash column to produce an ether-lean propane stream comprising propane and a second ether-rich water stream comprising water and dimethyl ether; and wherein the waste gas stream further comprises the ether-lean propane stream.

In some embodiments, the process further comprises fractionating the second ether-rich water stream to produce a second ether stream comprising dimethyl ether and a second water stream comprising water; and recycling the second water stream to the second water wash column.

In some embodiments, recycling at least the portion of the unsaturated light gas stream to the olefin fractionation zone comprises recycling at least the portion of the unsaturated light gas stream to the light ends stripper.

In some embodiments, recycling at least the portion of the unsaturated light gas stream to the olefin fractionation zone comprises recycling at least the portion of the unsaturated light gas stream to the deethanizer or the $C_2$ splitter.

In some embodiments, the process further comprises compressing at least the portion of the unsaturated light gas stream before recycling at least the portion of the unsaturated light gas stream.

In some embodiments, the crude olefin stream comprises a product of an ethanol dehydration unit or an alcohol to olefin unit.

In some embodiments, the oligomerization reaction zone comprises at least two stages; and wherein the at least two stages are in separate oligomerization reactors; or wherein the at least two stages are in a single oligomerization reactor.

In some embodiments, the crude olefin compressor has two or more stages.

Another aspect of the invention is a process to produce fuels from light olefins. In one embodiment, the process comprises concentrating a crude olefin stream comprising $C_2$ to $C_6$ olefins to produce a concentrated crude olefin stream. The concentrated crude olefin stream is fractionated in an olefin fractionation zone comprising an olefin fractionation column to produce an olefin stream comprising $C_2$ to $C_6$ olefins and a waste gas stream comprising $C_2$ to $C_3$ paraffins, hydrogen, and carbon monoxide. The olefin stream is oligomerized in an oligomerization reaction zone comprising an oligomerization reactor to produce an oligomerization effluent stream comprising $C_2$ to $C_{22+}$ olefins. The oligomerization effluent stream is fractionated in an oligomerization fractionation zone comprising an oligomerization fractionation column into a fractionated oligomerized stream comprising $C_{9+}$ olefins, a recycle olefin stream comprising $C_4$ to $C_8$ olefins, and an unsaturated light gas stream comprising $C_2$ to $C_3$ olefins and $C_2$ to $C_3$ paraffins. At least a portion of the unsaturated light gas stream is recycled to the olefin concentration zone or the olefin fractionation zone. The fractionated oligomerized stream is hydrogenated in the presence of hydrogen in a hydrogenation reaction zone comprising a hydrogenation reactor to form a hydrogenated stream comprising $C_1$ to $C_{22+}$ paraffins. The hydrogenated stream is fractionated in a hydrogenation fractionation zone comprising a hydrogenation fractionation column to produce at least an aviation fuel stream comprising $C_9$ to $C_{19}$ paraffins, or a diesel stream comprising $C_{19+}$ paraffins, or combinations thereof, or both.

In some embodiments, fractionating the hydrogenated stream to produce the aviation fuel stream, or the diesel stream, or both comprises fractionating the hydrogenated stream to produce the aviation fuel stream, or the diesel stream, or both and a saturated light gas stream comprising hydrogen and $C_1$ to $C_4$ paraffins, or a naphtha stream comprising $C_5$ to $C_8$ paraffins, or both.

FIG. 1 is an illustration of one embodiment of a process 100 for producing renewable fuels from light olefins.

A renewable light alcohol feed stream 105 is sent to an alcohol to olefin conversion zone 110. The light alcohol feed stream 105 comprises $C_1$ to $C_2$ alcohols. The light alcohol feed stream 105 may include contaminants such as other oxygenates, for example, ethers, ketones, or aldehydes, heavier alcohols, and denaturants, such as natural gasoline. The light alcohols in the light alcohol feed stream 105 are converted to $C_2$ to $C_6$ olefins forming a crude olefin stream 115.

The crude olefin stream 115 is sent to the olefin concentration zone 120 where the crude olefin stream is concentrated to form a concentrated olefin stream 125. One or more waste streams may be produced in the olefin concentration zone 120, such as water, oxygenate-rich water, ether-rich alcohol, and $CO_2$-rich spent caustic, as discussed below.

The concentrated olefin stream 125 is sent to the olefin fractionation zone 130 where it is separated into at least a waste gas stream 135 comprising $C_1$ to $C_3$ paraffins, hydrogen, and carbon monoxide and a fractionated olefin stream 140 comprising $C_2$ to $C_6$ olefins.

The fractionated olefin stream is sent to the oligomerization reaction zone 145 comprising an oligomerization reactor. The $C_2$ to $C_6$ olefins in the fractionated olefin stream are oligomerized to $C_2$ to $C_{22.}$ olefins.

The oligomerization effluent stream 150 is sent to the oligomerization fractionation zone 155 comprising a fractionation column. The oligomerization effluent stream 150 is separated into an unsaturated light gas stream 160 comprising $C_2$ to $C_3$ olefins and $C_2$ to $C_3$ paraffins, a recycle olefin stream 165 comprising $C_4$ to $C_5$ olefins, and fractionated oligomerization stream 170 comprising $C_{9+}$ olefins.

The unsaturated light gas stream 160 can be recycled to the olefin concentration zone 120 and/or the olefin fractionation zone 130.

The recycle olefin stream 165 is recycled to the oligomerization reaction zone 145.

The fractionated oligomerization stream 170 and hydrogen stream 172 are sent to the hydrogenation reaction zone 175 comprising a hydrogenation reactor where the $C_{9+}$ olefins are saturated.

The hydrogenation reactor effluent stream 180 is sent to a hydrogenation fractionation zone 185 comprising a hydrogenation fractionation column where the hydrogenated stream is separated into one or more products streams. The product streams may comprise one or more of a saturated light gas stream 190 comprising hydrogen and $C_1$ to $C_4$ paraffins, a naphtha stream 195 comprising $C_5$ to $C_8$ paraffins, an aviation fuel stream 200 comprising $C_9$ to $C_{19}$ paraffins, a diesel blendstock stream 205 comprising $C_{19+}$ paraffins, or combinations thereof. Recycle stream 210 comprising $C_{9+}$ paraffins can be recycled to the oligomerization reaction zone 145.

Figure 2:
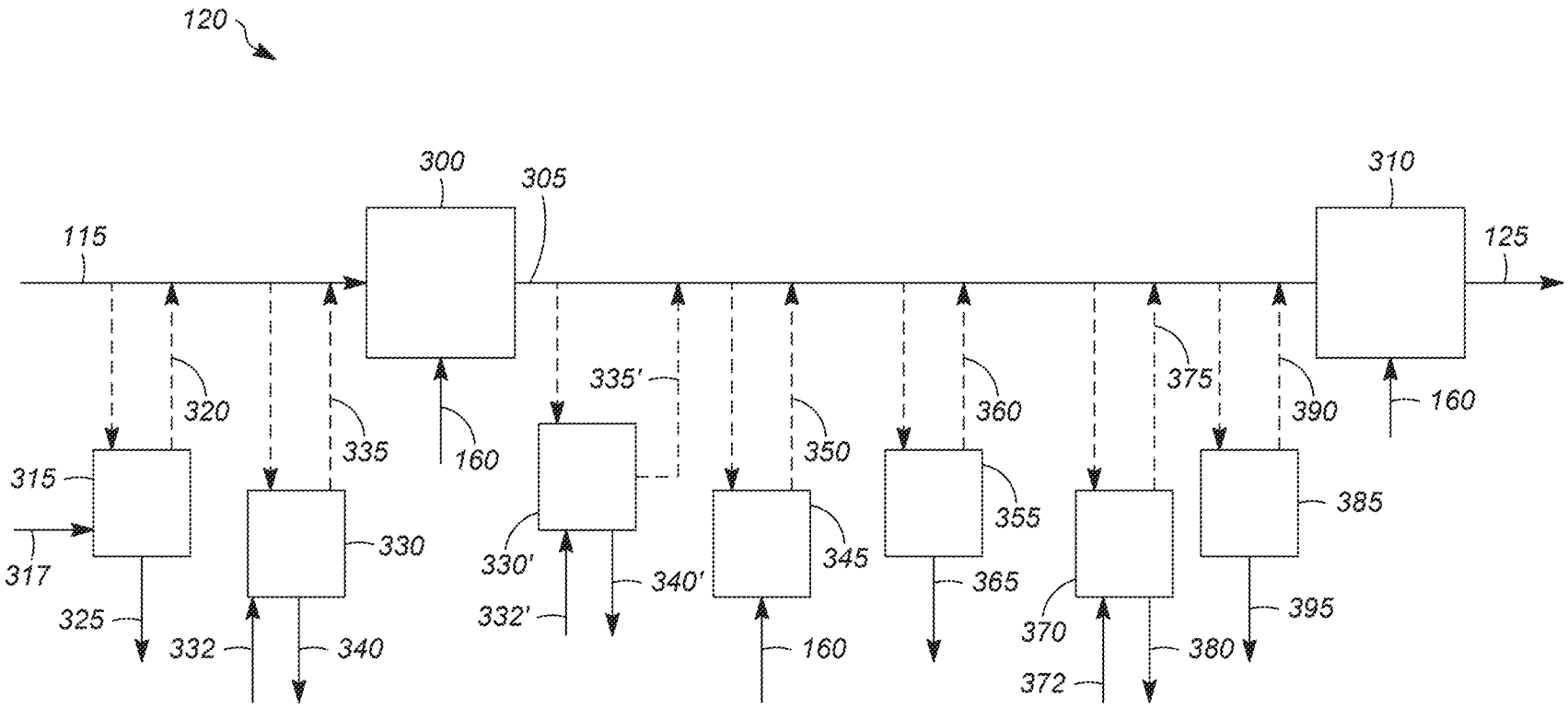
FIG. 2 is an illustration of one embodiment of an olefin concentration zone of the present invention.

FIG. 2 is an illustration of one embodiment of the olefin concentration zone 120.

The crude olefin stream 115 can be sent directly to the crude olefin compressor 300, and the compressed crude olefin stream 305 can be sent directly to the dryer 310.

Suitable dryers 310 include, but are not limited to, molecular sieves, hot air dryers, separate vapor-phase and liquid-phase dryers, or combinations thereof.

Alternatively, the crude olefin stream 115 and/or the compressed crude olefin stream 305 can be treated in one or more treatment steps.

The crude olefin stream 115 can optionally be sent to an ether absorber 315 where it is contacted with an alcohol stream 317 to produce an ether lean crude olefin stream 320 and an ether rich alcohol stream 325. The ether lean crude olefin stream 320 can be sent to the crude olefin compressor 300.

The crude olefin stream 115 can optionally be sent to an oxygenate absorber 330 where it is contacted with a water stream 332 to produce an oxygenate lean crude olefin stream 335 and an oxygenate rich water stream 340 before being sent to the crude olefin compressor 300.

The crude olefin stream 115 can optionally be sent to the ether absorber 315 and the oxygenate absorber 330. The crude olefin stream 115 can be sent to the ether absorber 315 where it is contacted with the alcohol stream 317 to produce an ether lean crude olefin stream 320 and an ether rich alcohol stream 325. The ether lean crude olefin stream 320 can be sent to the oxygenate absorber 330 and contacted with the water stream 332 to produce an ether and oxygenate lean crude olefin stream 335 and an oxygenate rich water stream 340 before being sent to the crude olefin compressor 300.

The compressed crude olefin stream 305 may be sent directly to the dryer 310.

Alternatively, the compressed crude olefin stream 305 can be sent to an oxygenate absorber 330' where it is contacted with a water stream 332' to produce an oxygenate lean crude olefin stream 335' and an oxygenate rich water stream 340'. The oxygenate lean crude olefin stream 335' can be sent to the dryer 310 or to another treatment step.

The compressed crude olefin stream 305 (or the oxygenate lean crude olefin stream 335') can be sent to a second compressor 345. The second compressed crude olefin stream (or the oxygenate lean crude olefin stream) 350 can be sent directly to the dryer 310 or to another treatment step.

The compressed crude olefin stream 305 (or the oxygenate lean crude olefin stream 335' or the second compressed crude olefin stream 350) can be sent to a light olefin stripper 355 where it is stripped to produce an ether rich light crude olefin stream 360 and an ether lean heavy crude olefin stream 365. The ether rich light crude olefin stream 360 can be sent directly to the dryer 310 or to another treatment step.

The compressed crude olefin stream 305 (or the oxygenate lean crude olefin stream 335', or the second compressed crude olefin stream 350, or the ether rich light crude olefin stream 360) can be sent to a caustic scrubber 370 where it is contacted with a caustic stream 372 to produce a carbon dioxide lean crude olefin stream 375 and a carbon dioxide rich spent caustic stream 380. The carbon dioxide lean crude olefin stream 375 can be sent directly to the dryer 310 or to another treatment step.

The compressed crude olefin stream 305 (or the oxygenate lean crude olefin stream 335', or the second compressed crude olefin stream 350, or the ether rich light crude olefin stream 360, or the carbon dioxide lean crude olefin stream 375) can be sent to a chiller 385 where it is chilled to produce a chilled crude olefin stream 390 and water stream 395. The chilled crude olefin stream 390 can be sent directly to the dryer 310 or to another treatment step.

When the chiller 385 is present, the dryer 310 comprises a liquid dryer and a vapor dryer. In this case, there will be a dried crude olefin liquid stream and a dried crude olefin vapor stream.

The dried crude olefin stream is the concentrated olefin stream 125 which is sent to the olefin fractionation zone 130.

The unsaturated light gas recycle stream 160 from the oligomerization fractionation zone 155 can be sent to the crude olefin compressor 300, the dryer 310, or the second compressor 345.

Figure 3:
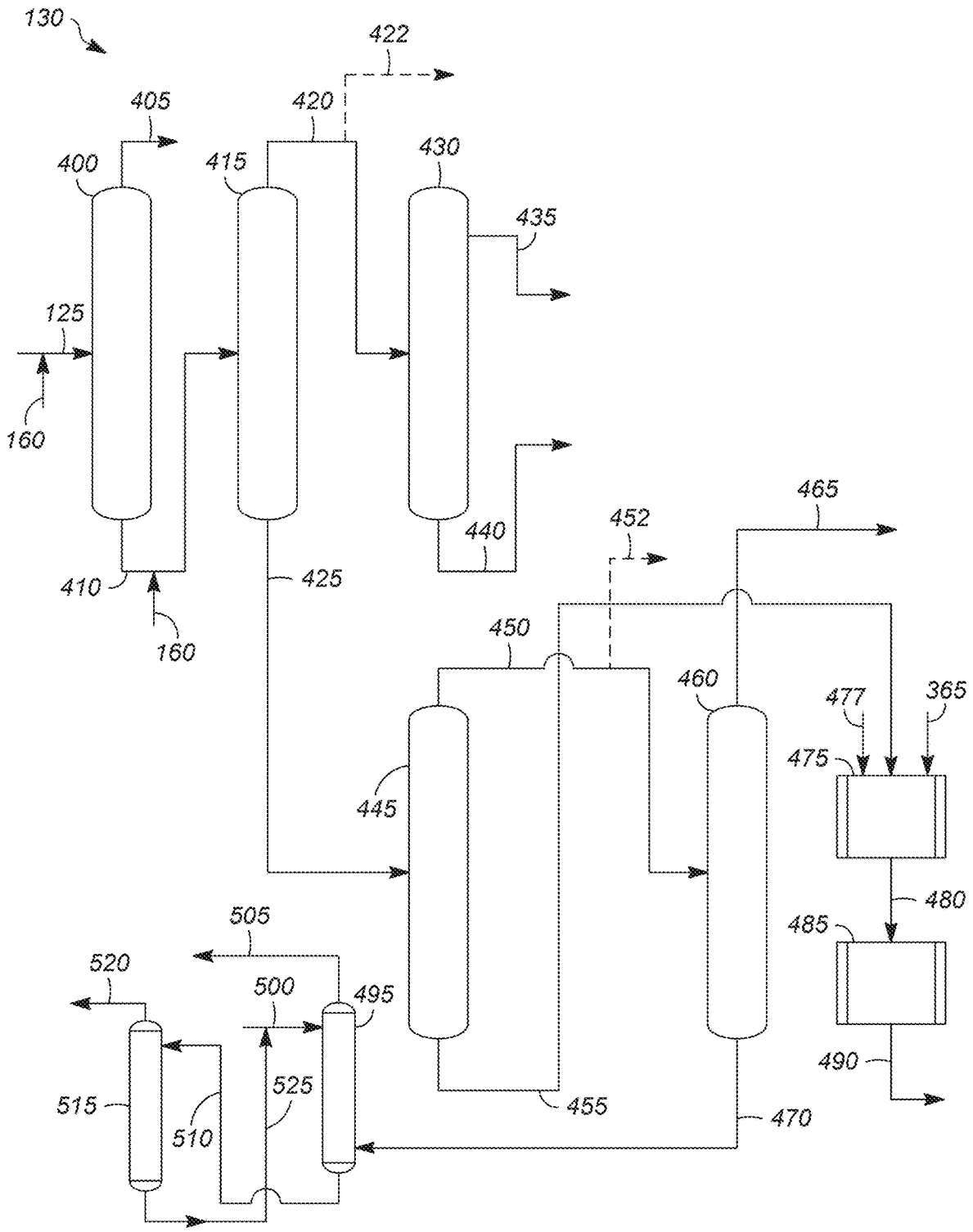
FIG. 3 is one embodiment of an olefin fractionation zone of the present invention.

FIG. 3 is an illustration of one embodiment of the olefin fractionation zone 130. The concentrated olefin stream 125 is sent to a light ends stripper column 400 where it is separated into a light ends stripper overhead stream 405 comprising hydrogen, methane, and carbon monoxide, and a light ends stripper bottom stream 410 comprising $C_2$ olefins.

The light ends stripper overhead stream 405 is sent to the waste gas stream 135.

The light ends stripper bottom stream 410 is sent to a deethanizer column 415 where it is separated into a deethanizer overhead stream 420 comprising $C_2$ olefins and paraffins and a deethanizer bottom stream 425 comprising $C_{3+}$ olefins and paraffins.

The unsaturated light gas recycle stream 160 from the oligomerization fractionation zone 155 can be sent to the light ends stripper column 400 or the deethanizer column 415. It can be sent as a separate stream to the light ends stripper column 400 or the deethanizer column 415, or it can be combined with the column feed (i.e., concentrated olefin stream 125 or light ends stripper bottom stream 410).

The deethanizer overhead stream 420 is sent to a $C_2$ splitter column 430 where it is separated into an ethylene stream 435 and an ethane stream 440. In some embodiments, a portion 422 of the deethanizer overhead stream 420 can bypass the $C_2$ splitter column 430 and be combined with the fractionated olefin stream 140. The ethane stream 440 is sent to the waste gas stream 135.

The deethanizer bottom stream 425 is sent to a olefin rectifier column 445 where it is separated into a olefin rectifier overhead stream 450 comprising $C_3$ olefins and paraffins and an olefin rectifier bottom stream 455 comprising $C_{4+}$ olefins and paraffins.

The olefin rectifier overhead stream 450 is sent to a $C_3$ splitter column 460 where it is separated into a propylene stream 465 and a $C_{3+}$ stream 470 comprising propane, and in some cases dimethyl ether.

The propylene stream 465 forms part of the fractionated olefin stream 140 sent to the oligomerization reaction zone 145. In some embodiments, a portion 452 of the olefin rectifier overhead stream 450 can bypass the $C_3$ splitter column 460 and be combined with the fractionated olefin stream 140.

The olefin rectifier bottom stream 455, the ether lean heavy crude olefin stream 365, and a hydrogen stream 477 are sent to a selective hydrogenation zone 475 where diolefins and acetylenes are selectively hydrogenated to olefins.

The saturated stream 480 is sent to a oxygenate removal zone 485 where trace oxygenates, such as dimethyl ether are removed forming a purified heavy olefin stream 490. The purified heavy olefin stream 490 forms part of the fractionated olefin stream 140 sent to the oligomerization reaction zone 145.

The $C_{3+}$ stream 470 is sent to an ether absorber 495 with water stream 500. The purified propane stream 505 exits the top of the ether absorber 495 and an ether-rich water stream 510 exits the bottom.

The ether-rich water stream 510 is sent to column 515 where it is separated into an ether overhead stream 520 and a lean water stream 525. The lean water stream 525 is sent to the ether absorber 495. The ether overhead stream 520 is recycled to an upstream alcohol to olefins conversion zone (not shown).

Alternatively, the ether absorber 495 could be upstream of the olefin rectifier column 445. In this case, the deethanizer bottom stream 425 is sent to the ether absorber 495. The purified propane stream 505 is sent to the olefin rectifier column 445.

The fractionated olefin stream 140 comprises the ethylene stream 435, the propylene stream 465, optionally the purified heavy olefin stream 490, and optionally portion 422 of the deethanizer overhead stream 420 and/or portion 452 of the olefin rectifier overhead stream 450.

The waste stream 135 comprises the light ends stripper overhead stream 405, the ethane stream 440, the purified propane stream 505 or the $C_{3+}$ stream 470, and optionally the olefin rectifier bottom stream 455.

Figure 4:
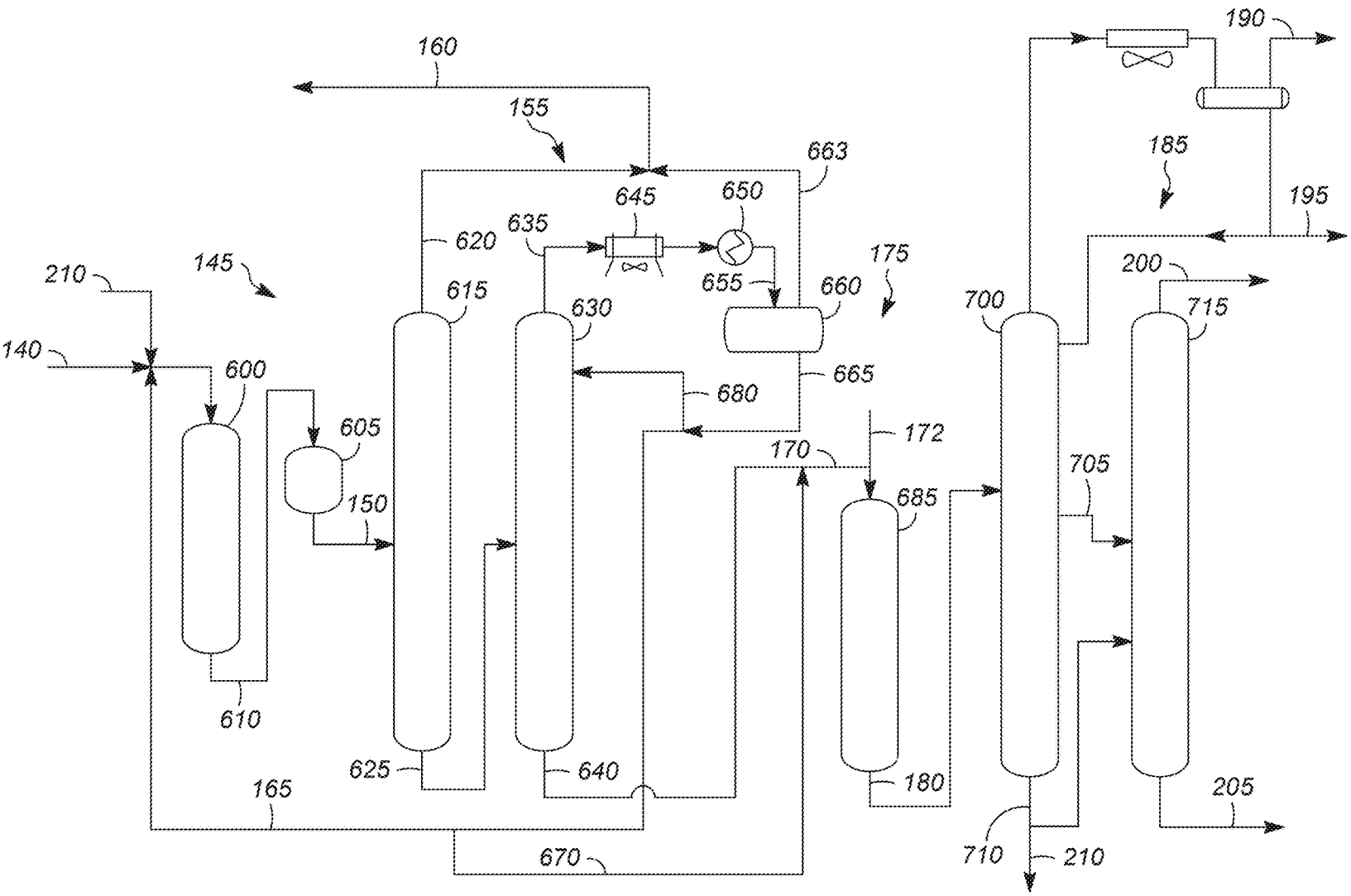
FIG. 4 is one embodiment of an oligomerization reaction zone, an oligomerization fractionation zone, a hydrogenation reaction zone, and a hydrogenation fractionation zone of the present invention.

FIG. 4 illustrates one embodiment of the oligomerization reaction zone 145, the oligomerization fractionation zone 155, the hydrogenation reaction zone 175, and the hydrogenation fractionation zone 185.

The fractionated olefin stream 140 from the olefin fractionation zone 130 is sent to the oligomerization reaction zone 145. The fractionated olefin stream 140 comprises $C_{2-6}$ olefins. Alternatively, instead of combining the ethylene stream 435 and the propylene stream 465, and optionally the purified heavy olefin stream 490, and optionally portion 422 of the deethanizer overhead stream 420 and/or portion 452 of the olefin rectifier overhead stream 450, two (or more) separate streams could be sent to the oligomerization reaction zone 145.

As shown, the oligomerization reaction zone 145 includes first stage oligomerization reactor 600 and second stage oligomerization reactor 605. The effluent stream 610 from the first stage oligomerization reactor 600 is sent to the second stage oligomerization reactor 605.

The oligomerization effluent stream 150 from the second stage oligomerization reactor 605 comprising $C_{9+}$ olefins and unreacted $C_{2-8}$ olefins is sent to the oligomerization fractionation zone 155. The oligomerization effluent stream 150 is sent to the depropanizer column 615 where it is separated into a depropanizer overhead stream 620 comprising unconverted $C_{2-4}$ olefins and a depropanizer bottom stream 625 comprising $C_{4+}$ olefins.

The depropanizer bottom stream 625 is sent to the olefin splitter column 630 where it is separated into an olefin splitter overhead stream 635 comprising $C_{4-8}$ olefins and an olefin splitter bottom stream 640 comprising $C_{9+}$ olefins.

The olefin splitter overhead stream 635 is cooled in air cooler 645 and heat exchanger 650, and the condensed stream 655 is sent to the olefin splitter receiver 660 where it is separated into olefin splitter vapor stream 663 and olefin splitter liquid stream 665. The olefin splitter liquid stream 665 from the olefin splitter receiver 660 can be divided into multiple liquid streams, for example, a drag stream 670 and a recycle stream 165. In addition, a portion 680 of the olefin splitter liquid stream 665 can be refluxed to the olefin splitter column 630.

The depropanizer overhead stream 620 and the olefin splitter vapor stream 663 are combined to form the unsaturated light gas stream 160 and sent to the crude olefin compressor 300, the dryer 310, or the second compressor 345 in the olefin concentration zone 120 and/or the light ends stripper column 400 or the deethanizer column 415 in the olefin fractionation zone 130.

The recycle stream 165 can be recycled to the first stage oligomerization reactor 600 of the oligomerization reaction zone 145.

The olefin splitter bottom stream 640 comprising $C_{9+}$ olefins and the drag stream 670 from the olefin splitter liquid stream 665 comprising $C_{4-8}$ olefins are combined to form fractionated oligomerization stream 170 which is sent to the hydrogenation reactor 685 in the hydrogenation reaction zone 175 along with hydrogen stream 172 where the olefins are converted to paraffins.

The hydrogenation reactor effluent stream 180 is sent to the stripper column 700 in the hydrogenation fractionation zone 185 where it is separated into a saturated light gas stream 190 comprising hydrogen and $C_1$ to $C_4$ paraffins, a renewable liquid naphtha stream 195 comprising $C_{5-8}$ paraffins, a stripper sidedraw stream 705 comprising $C_{9+}$ paraffins, and a stripper bottom stream 710 comprising $C_{10+}$ paraffins. Recycle stream 210 which is a portion of the stripper bottom stream 710 may be recycled to the first stage oligomerization reactor 600 of the oligomerization reaction zone 145.

The saturated light gas stream 190 can be used as a fuel gas. The renewable liquid naphtha stream 195 comprises paraffins and can be stabilized and used as gasoline blending stock, as a feedstock to steam cracking processes and the like, or pumped to a fired heater as fuel.

The stripper sidedraw stream 705 comprising $C_{9+}$ paraffins and stripper bottom stream 710 comprising $C_{10+}$ paraffins are sent to a jet fractionation column 715 where they are separated into a liquid aviation fuel stream 200, and a diesel blendstock stream 205. The liquid aviation fuel stream 200 comprises $C_{9-19}$ paraffins, meeting ASTM D7566 Annex 5 specifications and may be blended into aviation fuel. The diesel blendstock stream 205 comprises $C_{19+}$ paraffins and may be used as diesel blendstock. Those of skill in the art will understand that other separations could be performed.

Recycle stream 210 which is a portion of stripper bottom stream 710 comprising $C_{10+}$ paraffins from the stripper column 700 can be recycled to the oligomerization reaction zone 145. It can be mixed with the mixed olefin stream 105 and the recycle stream 165 from the olefin splitter receiver 660.

Typical process conditions for various streams are shown in Table 1.

TABLE 1

| Stream / | Temperature range | | Pressure range | |
|---|---|---|---|---|
| Equipment | ° F. | ° C. | psig | kPa(g) |
| 115 | 40-130 | 5-55 | 15-100 | 100-700 |
| 305 | | | 200-600 | 1400-4100 |
| 125 | 40-120 | 5-50 | 200-600 | 1400-4100 |
| 400 | Top: −180-10<br>Bottom: 0-100 | Top: −120-−10<br>Bottom: −15-40 | 150-600 | 1000-4100 |
| 415 | Top: −20-30<br>Bottom: 120-350 | Top:-30-0<br>Bottom: 50-180 | 300-450 | 2100-3100 |
| 430 | Top: −30-20<br>Bottom: 0-50 | Top: −35-−5<br>Bottom: −15-10 | 250-350 | 1700-2400 |
| 445 | Top: 90-150<br>Bottom: 200-450 | Top: 30-65<br>Bottom: 90-235 | 220-350 | 1500-2400 |
| 460 | Top: 80-130<br>Bottom: 100-160 | Top: 25-55<br>Bottom: 35-70 | 150-350 | 1000-2400 |
| 495 | 80-110 | 25-45 | 250-350 | 1700-2400 |

TABLE 1-continued

| Stream / Equipment | Temperature range ° F. | Temperature range ° C. | Pressure range psig | Pressure range kPa(g) |
|---|---|---|---|---|
| 515 | 250-330 | 120-165 | 40-80 | 250-550 |
| 600 | 300-550 | 150-290 | 500-1200 | 3400-8300 |
| 605 | 300-550 | 150-290 | 500-1200 | 3400-8300 |
| 615 | Top: 120-250<br>Bottom: 300-450 | Top: 50-120<br>Bottom: 150-235 | 100-200 | 700-1400 |
| 630 | Top: 150-250<br>Bottom: 350-500 | Top: 65-120<br>Bottom: 175-260 | 5-50 | 35-350 |
| 685 | 350-650 | 175-345 | 500-650 | 3400 |
| 700 | Top: 250-350<br>Bottom: 550-750 | Top: 120-175<br>Bottom: 285-400 | 50-150 | 350-1000 |
| 715 | Top: 200-450<br>Bottom: 550-750 | Top: 90-235<br>Bottom: 285-400 | 3 psia-15 psig | 20 kPa(a)-100 kPa(g) |

EXAMPLE

A comparison of a standard alcohol to renewable fuel process and one incorporating the unsaturated light gas stream recycle according to the present invention was made using a commercially available computer process modeling (UniSim Design Suite available from Honeywell).

The study was performed based on a methanol to jet process with 1,200,000 metric tonnes per year (1,200 kmta) of methanol feed with the process tuned to optimize the yield of SAF. The results are shown in Table 2. The study showed an improvement in the yield of SAF when the unsaturated light gas stream is recycled to the olefin concentration zone and the olefin fractionation zone includes the layout as described above.

TABLE 2

| | Base process | Present invention |
|---|---|---|
| Methanol Capacity (99.85 wt %), KMTA | 1,200 | |
| Operational Efficiency, hrs/yr | 8,600 | |
| SAF, KMTA | 435.4 | 453.3 |
| Diesel Blendstock, KMTA | 7.9 | 7.9 |
| Renewable Naphtha, KMTA | 16.9 | 15.6 |
| MeOH % C Yield to SAF | 82.1 wt-% | 85.4 wt-% |
| Light Olefin % C Yield to SAF | 88.6 wt-% | 89.9 wt-% |

SPECIFIC EMBODIMENTS

While the following is described in conjunction with specific embodiments, it will be understood that this description is intended to illustrate and not limit the scope of the preceding description and the appended claims.

A first embodiment of the invention is a process to produce fuels from light olefins comprising concentrating a crude olefin stream comprising $C_2$ to $C_6$ olefins to produce a concentrated crude olefin stream; fractionating the concentrated crude olefin stream in an olefin fractionation zone comprising an olefin fractionation column to produce an olefin stream comprising $C_2$ to $C_6$ olefins and a waste gas stream comprising $C_1$ to $C_3$ paraffins, hydrogen, and carbon monoxide; oligomerizing the olefin stream in an oligomerization reaction zone comprising an oligomerization reactor to produce an oligomerization effluent stream comprising $C_2$ to $C_{22+}$ olefins; fractionating the oligomerization effluent stream in an oligomerization fractionation zone comprising an oligomerization fractionation column into a fractionated oligomerized stream comprising $C_{9+}$ olefins, a recycle olefin stream comprising $C_4$ to $C_8$ olefins, and an unsaturated light gas stream comprising $C_2$ to $C_3$ olefins and $C_2$ to $C_3$ paraffins; recycling at least a portion of the unsaturated light gas stream to the olefin concentration zone or the olefin fractionation zone; and fractionating the fractionated oligomerized stream to produce at least one fuel stream. An embodiment of the invention is one, any or all of prior embodiments in this paragraph up through the first embodiment in this paragraph further comprising; hydrogenating the fractionated oligomerized stream in the presence of hydrogen in a hydrogenation reaction zone comprising a hydrogenation reactor before fractionating the fractionated oligomerized stream to form a hydrogenated stream comprising $C_1$ to $C_{22+}$ paraffins; wherein fractionating the fractionated oligomerized stream comprises fractionating the hydrogenated stream in the hydrogenation fractionation zone to produce an aviation fuel stream comprising $C_9$ to $C_{19}$ paraffins, or a diesel stream comprising $C_{19+}$ paraffins, or both, and optionally a saturated light gas stream comprising hydrogen and $C_1$ to $C_4$ paraffins, or a naphtha stream comprising $C_5$ to $C_8$ paraffins, or. An embodiment of the invention is one, any or all of prior embodiments in this paragraph up through the first embodiment in this paragraph wherein concentrating the crude olefin stream comprises compressing the crude olefin stream in a crude olefin compressor to form a compressed crude olefin stream; drying the compressed crude olefin stream in a dryer to produce the concentrated crude olefin stream. An embodiment of the invention is one, any or all of prior embodiments in this paragraph up through the first embodiment in this paragraph further comprising contacting the crude olefin stream or a compressed crude olefin stream with water in an oxygenate absorber to produce an oxygenate lean crude olefin stream or a compressed oxygenate lean crude olefin stream and an oxygenate rich water stream; and wherein compressing the crude olefin stream comprises compressing the oxygenate lean crude olefin stream; or wherein drying the compressed crude olefin stream comprises drying the compressed oxygenate lean crude olefin stream. An embodiment of the invention is one, any or all of prior embodiments in this paragraph up through the first embodiment in this paragraph further comprising contacting the crude olefin stream with an alcohol in an ether absorber to produce an ether lean crude olefin stream and an ether rich alcohol stream; and wherein compressing the crude olefin stream comprises compressing the ether lean crude olefin stream. An embodiment of the invention is one, any or all of prior embodiments in this paragraph up through the first embodiment in this paragraph further comprising stripping the compressed crude olefin stream in a light olefins stripper to produce an ether rich light crude olefin stream and an ether lean heavy crude olefin stream; and wherein drying the compressed crude olefin stream comprises drying the ether rich light crude olefin stream. An embodiment of the invention is one, any or all of prior embodiments in this paragraph up through the first embodiment in this paragraph further comprising contacting the compressed crude olefin stream with a caustic solution in a scrubber to produce a carbon dioxide lean crude olefin stream and a carbon dioxide rich spent caustic stream; and wherein drying the compressed crude olefin stream comprises drying the carbon dioxide lean crude olefin stream. An embodiment of the invention is one, any or all of prior embodiments in this paragraph up through the first embodiment in this paragraph wherein drying the compressed crude olefin stream comprises drying the compressed crude olefin stream with a molecular sieve, or in a dryer, or in a combination vapor-phase and liquid-phase dryer, or combinations thereof. An embodiment of the invention is one, any or all of prior embodiments in this paragraph up through the first embodiment in this paragraph wherein recycling at least the portion of the unsaturated light gas stream to the olefin concentration zone comprises recycling at least the portion of the unsaturated light gas stream to the crude olefin compressor or a second compressor; or recycling at least the portion of the unsaturated light gas stream to the dryer; or both. An embodiment of the invention is one, any or all of prior embodiments in this paragraph up through the first embodiment in this paragraph wherein fractionating the concentrated olefin stream comprises stripping the concentrated olefin stream in a light ends stripper to produce a waste gas stream comprising hydrogen, methane, and CO and a stripped olefin stream comprising $C_{2+}$ olefins; and wherein oligomerizing the olefin stream from the olefin fractionation zone comprises oligomerizing the stripped olefin stream. An embodiment of the invention is one, any or all of prior embodiments in this paragraph up through the first embodiment in this paragraph further comprising fractionating the stripped olefin stream in a deethanizer to produce a crude ethylene stream comprising ethylene and ethane and a heavy olefin stream comprising $C_{3+}$ olefins; and fractionating at least a portion of the crude ethylene stream in a $C_2$ splitter to create an ethylene stream and an ethane stream; wherein oligomerizing the olefin stream from the olefin fractionation zone comprises oligomerizing the ethylene stream, optionally a portion of the crude ethylene stream, and optionally the heavy olefin stream; and wherein the waste gas stream further comprises the ethane stream and optionally the heavy olefin stream. An embodiment of the invention is one, any or all of prior embodiments in this paragraph up through the first embodiment in this paragraph further comprising fractionating the heavy olefin stream from the deethanizer in an olefin rectifier to produce a crude propylene stream comprising propylene and propane and a second heavy olefin stream comprising $C_{4+}$ olefins; wherein the olefin stream from the olefin fractionation zone comprises the ethylene stream, the crude propylene stream, optionally the second heavy olefin stream, and optionally a portion of the crude ethylene stream; and wherein the waste gas stream further comprises the ethane stream and optionally the second heavy olefin stream. An embodiment of the invention is one, any or all of prior embodiments in this paragraph up through the first embodiment in this paragraph further comprising fractionating at least a portion of the crude propylene stream in a $C_3$ splitter to produce a propylene stream and a propane stream; and wherein the olefin stream from the olefin fractionation zone comprises the ethylene stream, the propylene stream, optionally the second heavy olefin stream, optionally a portion of the crude ethylene stream, and optionally a portion of the crude propylene stream; and wherein the waste gas stream further comprises the ethane stream, the propane stream, and optionally the second heavy olefin stream. An embodiment of the invention is one, any or all of prior embodiments in this paragraph up through the first embodiment in this paragraph further comprising contacting the heavy olefin stream with water in a water wash column to produce an ether-lean heavy olefin stream comprising $C_{3+}$ olefins and an ether-rich water stream comprising water and dimethyl ether; and wherein fractionating the heavy olefin stream from the deethanizer comprises fractionating the ether-lean heavy olefin stream. An embodiment of the invention is one, any or all of prior embodiments in this paragraph up through the first embodiment in this paragraph further comprising contacting the propane stream with water in a second water wash column to produce an ether-lean propane stream comprising propane and a second ether-rich water stream comprising water and dimethyl ether; and wherein the waste gas stream further comprises the ether-lean propane stream. An embodiment of the invention is one, any or all of prior embodiments in this paragraph up through the first embodiment in this paragraph wherein recycling at least the portion of the unsaturated light gas stream to the olefin concentration zone comprises recycling at least the portion of the unsaturated light gas stream to the light ends stripper. An embodiment of the invention is one, any or all of prior embodiments in this paragraph up through the first embodiment in this paragraph wherein recycling at least the portion of the unsaturated light gas stream to the olefin concentration zone comprises recycling at least the portion of the unsaturated light gas stream to the deethanizer or the $C_2$ splitter.

A second embodiment of the invention is a process to produce fuels from light olefins comprising concentrating a crude olefin stream comprising $C_2$ to $C_6$ olefins to produce a concentrated crude olefin stream; fractionating the concentrated crude olefin stream in an olefin fractionation zone comprising an olefin fractionation column to produce an olefin stream comprising $C_2$ to $C_6$ olefins and a waste gas stream comprising $C_1$ to $C_3$ paraffins, hydrogen, and carbon monoxide; oligomerizing the olefin stream in an oligomerization reaction zone comprising an oligomerization reactor to produce an oligomerization effluent stream comprising $C_2$ to $C_{22+}$ olefins; fractionating the oligomerization effluent stream in an oligomerization fractionation zone comprising an oligomerization fractionation column into a fractionated oligomerized stream comprising $C_{9+}$ olefins, a recycle olefin stream comprising $C_4$ to $C_8$ olefins, and an unsaturated light gas stream comprising $C_2$ to $C_3$ olefins and $C_2$ to $C_3$ paraffins; recycling at least a portion of the unsaturated light gas stream to the olefin concentration zone or the olefin fractionation zone; hydrogenating the fractionated oligomerized stream in the presence of hydrogen in a hydrogenation reaction zone comprising a hydrogenation reactor to form a hydrogenated stream comprising $C_1$ to $C_{22}$ paraffins; and fractionating the hydrogenated stream in a hydrogenation fractionation zone comprising a hydrogenation fractionation column to produce at least an aviation fuel stream comprising $C_9$ to $C_{19}$ paraffins, or a diesel stream comprising $C_{19+}$ paraffins, or combinations thereof. An embodiment of the invention is one, any or all of prior embodiments in this paragraph up through the second embodiment in this paragraph wherein fractionating the concentrated olefin stream comprises stripping the concentrated olefin stream in a light ends stripper to produce a waste gas stream comprising hydrogen, methane, and CO and a stripped olefin stream comprising $C_{2+}$ olefins; fractionating the stripped olefin stream in a deethanizer to produce a crude ethylene stream comprising ethylene and ethane and a heavy olefin stream comprising $C_{3+}$ olefins; and fractionating at least a portion of the crude ethylene stream in a $C_2$ splitter to create an ethylene stream and an ethane stream; wherein oligomerizing the olefin stream from the olefin fractionation zone comprises oligomerizing the ethylene stream, optionally a portion of the crude ethylene stream, and optionally the heavy olefin stream; and wherein the waste gas stream further comprises the ethane stream and optionally the heavy olefin stream. An embodiment of the invention is one, any or all of prior embodiments in this paragraph up through the second embodiment in this paragraph further comprising fractionating the heavy olefin stream from the deethanizer in an olefin rectifier to produce a crude propylene stream comprising propylene and propane and a second heavy olefin stream comprising $C_{4+}$ olefins; fractionating at least a portion of the crude propylene stream in a $C_3$ splitter to produce a propylene stream and a propane stream; and wherein the olefin stream from the olefin fractionation zone comprises the ethylene stream, the propylene stream, optionally the second heavy olefin stream, optionally a portion of the crude ethylene stream, and optionally a portion of the crude propylene stream; and wherein the waste gas stream further comprises the ethane stream, the propane stream, and optionally the second heavy olefin stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A process to produce fuels from light olefins comprising:

concentrating a crude olefin stream comprising $C_2$ to $C_6$ olefins to produce a concentrated crude olefin stream;

fractionating the concentrated crude olefin stream in an olefin fractionation zone comprising an olefin fractionation column to produce an olefin stream comprising $C_2$ to $C_6$ olefins and a waste gas stream comprising $C_1$ to $C_3$ paraffins, hydrogen, and carbon monoxide;

oligomerizing the olefin stream in an oligomerization reaction zone comprising an oligomerization reactor to produce an oligomerization effluent stream comprising $C_2$ to $C_{22+}$ olefins;

fractionating the oligomerization effluent stream in an oligomerization fractionation zone comprising an oligomerization fractionation column into a fractionated oligomerized stream comprising $C_{9+}$ olefins, a recycle olefin stream comprising $C_4$ to $C_8$ olefins, and an unsaturated light gas stream comprising $C_2$ to $C_3$ olefins and $C_2$ to $C_3$ paraffins;

recycling at least a portion of the unsaturated light gas stream to the olefin concentration zone or the olefin fractionation zone; and fractionating the fractionated oligomerized stream to produce at least one fuel stream.

2. The process of claim 1 further comprising;

hydrogenating the fractionated oligomerized stream in the presence of hydrogen in a hydrogenation reaction zone comprising a hydrogenation reactor before fractionating the fractionated oligomerized stream to form a hydrogenated stream comprising $C_1$ to $C_{22+}$ paraffins;

wherein fractionating the fractionated oligomerized stream comprises:

fractionating the hydrogenated stream in a hydrogenation fractionation zone comprising a hydrogenation fractionation column to produce an aviation fuel stream comprising $C_9$ to $C_{19}$ paraffins, or a diesel stream comprising $C_{19+}$ paraffins, or both, and optionally a saturated light gas stream comprising hydrogen and $C_1$ to $C_4$ paraffins, or a naphtha stream comprising $C_5$ to $C_8$ paraffins, or both.

3. The process of claim 1 wherein concentrating the crude olefin stream comprises:

compressing the crude olefin stream in a crude olefin compressor to form a compressed crude olefin stream; and drying the compressed crude olefin stream in a dryer to produce the concentrated crude olefin stream.

4. The process of claim 3 further comprising:

contacting the crude olefin stream or a compressed crude olefin stream with water in an oxygenate absorber to produce an oxygenate lean crude olefin stream or a compressed oxygenate lean crude olefin stream and an oxygenate rich water stream; and wherein compressing the crude olefin stream comprises compressing the oxygenate lean crude olefin stream; or wherein drying the compressed crude olefin stream comprises drying the compressed oxygenate lean crude olefin stream.

5. The process of claim 3 further comprising:

contacting the crude olefin stream with an alcohol in an ether absorber to produce an ether lean crude olefin stream and an ether rich alcohol stream; and wherein compressing the crude olefin stream comprises compressing the ether lean crude olefin stream.

6. The process of claim 3 further comprising:

stripping the compressed crude olefin stream in a light olefins stripper to produce an ether rich light crude olefin stream and an ether lean heavy crude olefin stream; and wherein drying the compressed crude olefin stream comprises drying the ether rich light crude olefin stream.

7. The process of claim 3 further comprising:

contacting the compressed crude olefin stream with a caustic solution in a scrubber to produce a carbon dioxide lean crude olefin stream and a carbon dioxide rich spent caustic stream; and wherein drying the compressed crude olefin stream comprises drying the carbon dioxide lean crude olefin stream.

8. The process of claim 3 wherein drying the compressed crude olefin stream comprises drying the compressed crude olefin stream with a molecular sieve, or in a dryer, or in a combination vapor-phase and liquid-phase dryer, or combinations thereof.

9. The process of claim 3 wherein recycling at least the portion of the unsaturated light gas stream to the olefin concentration zone comprises:

recycling at least the portion of the unsaturated light gas stream to the crude olefin compressor or a second compressor; or recycling at least the portion of the unsaturated light gas stream to the dryer;

or both.

10. The process of claim 1 wherein fractionating the concentrated olefin stream comprises:

stripping the concentrated olefin stream in a light ends stripper to produce a waste gas stream comprising hydrogen, methane, and CO and a stripped olefin stream comprising $C_{2+}$ olefins; and wherein oligomerizing the olefin stream from the olefin fractionation zone comprises oligomerizing the stripped olefin stream.

11. The process of claim 10 further comprising:

fractionating the stripped olefin stream in a deethanizer to produce a crude ethylene stream comprising ethylene and ethane and a heavy olefin stream comprising $C_{3+}$ olefins; and fractionating at least a portion of the crude ethylene stream in a $C_2$ splitter to create an ethylene stream and an ethane stream;

wherein oligomerizing the olefin stream from the olefin fractionation zone comprises oligomerizing the ethylene stream, optionally a portion of the crude ethylene stream, and optionally the heavy olefin stream; and wherein the waste gas stream further comprises the ethane stream and optionally the heavy olefin stream.

12. The process of claim 11 further comprising:

fractionating the heavy olefin stream from the deethanizer in an olefin rectifier to produce a crude propylene stream comprising propylene and propane and a second heavy olefin stream comprising $C_{4+}$ olefins;

wherein the olefin stream from the olefin fractionation zone comprises the ethylene stream, the crude propylene stream, optionally the second heavy olefin stream, and optionally a portion of the crude ethylene stream; and wherein the waste gas stream further comprises the ethane stream and optionally the second heavy olefin stream.

13. The process of claim 12 further comprising:

fractionating at least a portion of the crude propylene stream in a $C_3$ splitter to produce a propylene stream and a propane stream;

wherein the olefin stream from the olefin fractionation zone comprises the ethylene stream, the propylene stream, optionally the second heavy olefin stream, optionally a portion of the crude ethylene stream, and optionally a portion of the crude propylene stream; and wherein the waste gas stream further comprises the ethane stream, the propane stream, and optionally the second heavy olefin stream.

14. The process of claim 12 further comprising:

contacting the heavy olefin stream with water in a water wash column to produce an ether-lean heavy olefin stream comprising $C_{3+}$ olefins and an ether-rich water stream comprising water and dimethyl ether; and wherein fractionating the heavy olefin stream from the deethanizer comprises fractionating the ether-lean heavy olefin stream.

15. The process of claim 13 further comprising:

contacting the propane stream with water in a second water wash column to produce an ether-lean propane stream comprising propane and a second ether-rich water stream comprising water and dimethyl ether; and wherein the waste gas stream further comprises the ether-lean propane stream.

16. The process of claim 10 wherein recycling at least the portion of the unsaturated light gas stream to the olefin concentration zone comprises:

recycling at least the portion of the unsaturated light gas stream to the light ends stripper.

17. The process of claim 11 wherein recycling at least the portion of the unsaturated light gas stream to the olefin concentration zone comprises:

recycling at least the portion of the unsaturated light gas stream to the deethanizer or the $C_2$ splitter.

18. A process to produce fuels from light olefins comprising:

concentrating a crude olefin stream comprising $C_2$ to $C_6$ olefins to produce a concentrated crude olefin stream;

fractionating the concentrated crude olefin stream in an olefin fractionation zone comprising an olefin fractionation column to produce an olefin stream comprising $C_2$ to $C_6$ olefins and a waste gas stream comprising $C_1$ to $C_3$ paraffins, hydrogen, and carbon monoxide;

oligomerizing the olefin stream in an oligomerization reaction zone comprising an oligomerization reactor to produce an oligomerization effluent stream comprising $C_2$ to $C_{22+}$ olefins;

fractionating the oligomerization effluent stream in an oligomerization fractionation zone comprising an oligomerization fractionation column into a fractionated oligomerized stream comprising $C_{9+}$ olefins, a recycle olefin stream comprising $C_4$ to $C_8$ olefins, and an unsaturated light gas stream comprising $C_2$ to $C_3$ olefins and $C_2$ to $C_3$ paraffins;

recycling at least a portion of the unsaturated light gas stream to the olefin concentration zone or the olefin fractionation zone;

hydrogenating the fractionated oligomerized stream in the presence of hydrogen in a hydrogenation reaction zone comprising a hydrogenation reactor to form a hydrogenated stream comprising $C_1$ to $C_{22+}$ paraffins; and fractionating the hydrogenated stream in a hydrogenation fractionation zone comprising a hydrogenation fractionation column to produce at least an aviation fuel stream comprising $C_9$ to $C_{19}$ paraffins, or a diesel stream comprising $C_{19+}$ paraffins, or combinations thereof.

19. The process of claim 18 wherein fractionating the concentrated olefin stream comprises:

stripping the concentrated olefin stream in a light ends stripper to produce a waste gas stream comprising hydrogen, methane, and CO and a stripped olefin stream comprising $C_{2+}$ olefins;

fractionating the stripped olefin stream in a deethanizer to produce a crude ethylene stream comprising ethylene and ethane and a heavy olefin stream comprising $C_{3+}$ olefins; and fractionating at least a portion of the crude ethylene stream in a $C_2$ splitter to create an ethylene stream and an ethane stream;

wherein oligomerizing the olefin stream from the olefin fractionation zone comprises oligomerizing the ethylene stream, optionally a portion of the crude ethylene stream, and optionally the heavy olefin stream; and wherein the waste gas stream further comprises the ethane stream and optionally the heavy olefin stream.

20. The process of claim 19 further comprising:

fractionating the heavy olefin stream from the deethanizer in an olefin rectifier to produce a crude propylene stream comprising propylene and propane and a second heavy olefin stream comprising $C_{4+}$ olefins; and fractionating at least a portion of the crude propylene stream in a $C_3$ splitter to produce a propylene stream and a propane stream;

wherein the olefin stream from the olefin fractionation zone comprises the ethylene stream, the propylene stream, optionally the second heavy olefin stream, optionally a portion of the crude ethylene stream, and optionally a portion of the crude propylene stream; and wherein the waste gas stream further comprises the ethane stream, the propane stream, and optionally the second heavy olefin stream.

* * * * *